United States Patent [19]

Sincere

[11] Patent Number: 5,022,822

[45] Date of Patent: Jun. 11, 1991

[54] COMPRESSOR BLADE ATTACHMENT ASSEMBLY

[75] Inventor: Steven M. Sincere, Hobe Sound, Fla.

[73] Assignee: United Technologies Corporation, Hartford, Conn.

[21] Appl. No.: 427,224

[22] Filed: Oct. 24, 1989

[51] Int. Cl.[5] ..... F01D 5/30

[52] U.S. Cl. ..... 416/219 R; 416/248

[58] Field of Search ..... 416/204 A, 219 R, 248, 416/500, 217

[56] References Cited

U.S. PATENT DOCUMENTS

| | | | |
|---|---|---|---|
| 3,339,833 | 9/1967 | Bill et al. | 416/219 R |
| 3,627,448 | 12/1971 | Rupp | 416/220 |
| 3,692,429 | 9/1972 | Redding | 416/219 X |
| 4,260,331 | 4/1981 | Goodwin | 416/219 |
| 4,417,854 | 11/1983 | Cain et al. | 416/219 R X |
| 4,595,340 | 6/1986 | Klassen et al. | 416/248 X |
| 4,645,425 | 2/1987 | Morrison, Jr. | 416/215 |

*Primary Examiner*—Edward K. Look
*Assistant Examiner*—James A. Larson
*Attorney, Agent, or Firm*—Edward L. Kochey, Jr.

[57] ABSTRACT

Compressor disk (10) has a plurality of rim portions (16, 20, 24) of increasing diameter. Parallel blade retention grooves (30, 32, 34) at locations commensurate with their respective rim portion diameters receive blade tongues (46, 48, 50). Dead load is decreased resulting in a smaller, lighter weight compressor.

7 Claims, 1 Drawing Sheet

COMPRESSOR BLADE ATTACHMENT ASSEMBLY

DESCRIPTION

1. Technical Field

The invention relates to axial flow compressors having a high airflow path convergence, and in particular to a blade attachment to the compressor disk.

2. Background of the Invention

Advanced high airflow turbine fan engines have compressors with low hub/tip ratios. These compressors have rapidly decreasingly flowpaths and with the restricted outside diameter they have a high convergent angle formed by the blade platform of the compressor blades, particularly in the first stages.

It is required that the blades be attached to an annular retaining structure known as a disk. This disk is largely sized by centrifugal effects of any mass that is not continuous about the circumference of the disk. This mass which is not continuous is known as dead load. With the disk grooved to accept tongues of the blades, the portion of the disk between adjacent grooves as well as the tongue and the blade itself all contributes to dead load.

An integrally bladed rotor is optimum from the weight and structural standpoint since it does not use slots and a maximum amount of the material is live load. This, however, does not allow for individual blade removal for replacement in the event of blade damage.

Conventional slotted blade attachments suffer extreme weight and strength penalties. The current method of securing the blade is through the use of a tongue and groove method wherein each blade has a single tongue at its base. This tongue aligns in a slot cut into the rim of the disk. The groove is typically straight and in the axial direction of the compressor, or at a slight angle to it. Because of the steep angle of the blade platform, the downstream end of the blade has a long tongue and the disk a deep groove. Accordingly, this downstream portion contributes substantial dead load.

It is an object of the invention to reduce the dead load of the compressor structure and therefore the disk size in order to help reduce the total engine weight.

SUMMARY OF THE INVENTION

The compressor disk has a plurality of axially spaced rim portions which vary from a minimum outside diameter of the upstream end to a maximum outside diameter of the downstream end. For each blade to be installed there is a groove arrangement comprising a substantially axially extending blade retention groove through each rim portion. Each groove is located at a diameter commensurate with the outside diameter of the respective rim portion. Each blade has a plurality of tongues such that one is engageable with each groove portion.

The rim portions may be contiguous or may be separated by narrow circumferential grooves which facilitate the machining of the groove portions and each rim portion. The live load is thereby increased and the dead load decreased.

DESCRIPTION OF THE PREFERRED EMBODIMENT

Figure 1:
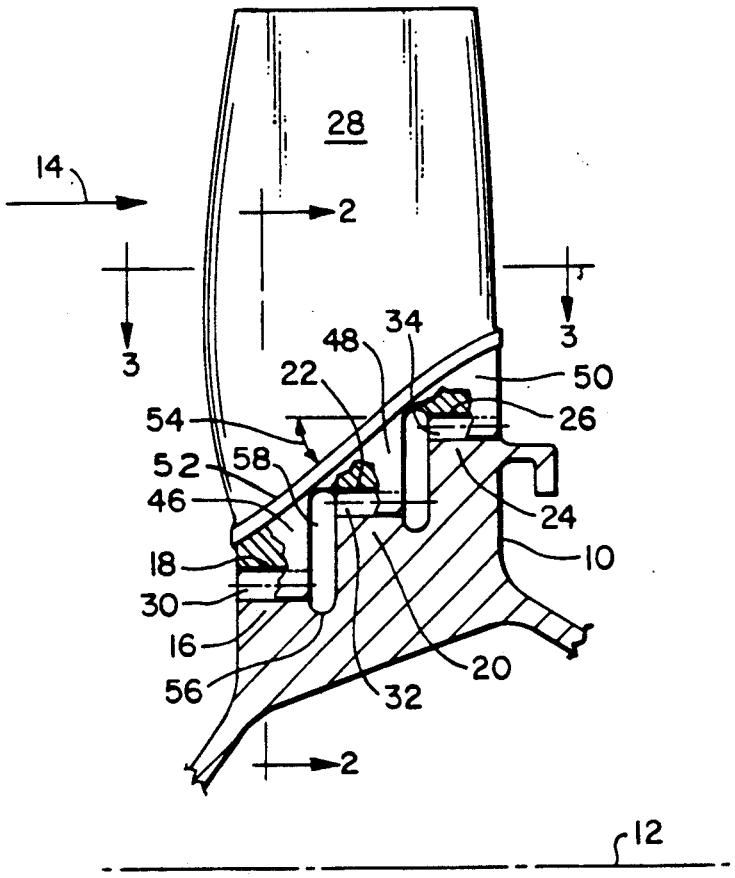
FIG. 1 is a sectional elevation through one-half the disk and the blade.
Figure 2:
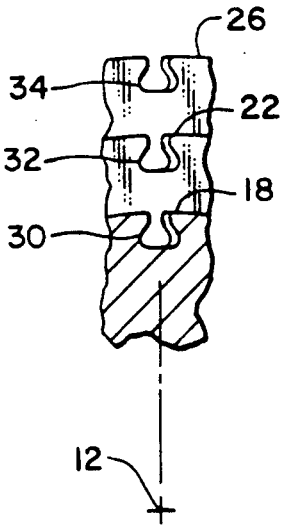
FIG. 2 is a sectional elevation through the disk in the axial direction taken at section 2—2 of FIG. 1.

Disk 10 of an axial flow compressor is rotatable around centerline 12 of the compressor. A flow of air 14 being compressed moves from an upstream to a downstream direction.

The disk 10 has a first rim portion 16 at the upstream end having an outside diameter 18. It has an axially spaced second rim portion 20 with an outside diameter 22 greater than the diameter 18. There is a third rim portion 24 of a still greater outside diameter 26.

A groove arrangement for each blade 28 includes a blade retention groove 30 through rim portion 16. Also, there is a blade retention groove 32 through rim portion 20 and a blade retention groove 34 through rim portion 24.

Figure 3:
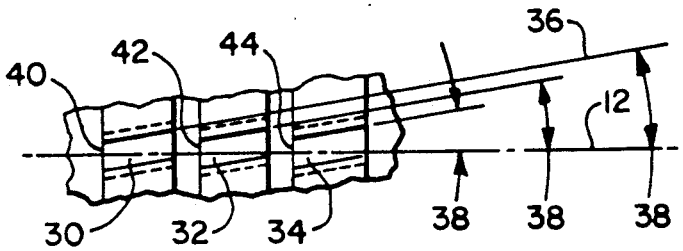
FIG. 3 is a plan view of the disk from section 3—3 of FIG. 1. showing the groove portions.

Each of the grooves extend in the direction 36 substantially axially while as illustrated in FIG. 3 they are established at a slight angle 38 with respect to the axial direction, this angle may be nominally 45 degrees.

While the grooves each extend at a slight angle with respect to the axis, the first edge 40, 42 and 44 of each groove are in precise axial alignment.

Each blade 28 has a plurality of tongues engageable with each groove arrangement. Tongue 46 is engageable within groove 30. Tongue 48 is engageable within groove 32 while tongue 50 is engageable within groove 34.

The blade platform 52 is at an angle 54 of 40 degrees with respect to the axis of the compressor. The invention has significance where this angle is greater than 30 degrees.

The manufacture of the grooves and corresponding tongues requires exacting tolerances for proper load distribution between the tongues. To facilitate this either the tongue of each blade or the surface within each groove is coated with a material such as Cu/Ni which is softer than either the rim material or the tongue material. Slight deviations in tolerance are absorbed by deformation of this softer material, thereby improving the load distribution between the plurality of tongues on each blade.

Circumferential reduced diameter portion 56 provides a circumferential space 58. This facilitates the broaching of groove 30.

In the prior art, a groove such as groove 30 would extend through the entire disk. All the material beyond the corresponding diameter would be dead load, as would the long tongues on the blade. Furthermore, the long tongues would be highly susceptible to bending. The stepped blade attachment of this invention decreases the tongue length, and substantially increases the live load and accordingly decreases a dead load resulting in a smaller, lighter weight compressor.

I claim:

1. A blade attachment assembly for an axial compressor, which compressor has a rapidly decreasing flowpath in the axial direction, comprising:

a disk having a plurality of axially spaced rim portions forming outside diameters from a minimum outside diameter at the upstream side to a maximum outside diameter at the downstream side;

a plurality of compressor blades, each having a blade platform at a platform angle with respect to the intended axial flowpath past the blade;

a plurality of groove arrangements; one groove arrangement for each blade to be installed;

each groove arrangement comprising a substantially axially extending blade retention groove through each of said rim portions, each groove located at a diameter commensurate with the outside diameter of the respective rim portion; and each blade having a plurality of tongues, each tongue engageable with one of each of said grooves of said groove arrangement in each of said rim portions;

whereby increased live load is obtained with the rim portion beyond the minimum diameter rim portion.

2. A blade attachment assembly as in claim 1:

wherein grooves arrangement comprises a plurality of parallel grooves.

3. A blade attachment assembly as in claim 2:

a circumferential reduced diameter portion intermediate adjacent rim portions, of a diameter less than the diameter defined by the root of the grooves in the smaller diameter adjacent rim portion.

4. A blade attachment assembly as in claim 3:

said plurality of grooves of each groove arrangement axially extending at a slight angle with respect to said axial direction, but having a first edge of each groove in precise axial alignment.

5. A blade attachment assembly as in claim 4:

at least one of said each groove and said tongue coated with a material softer than the material of said rim portion and said tongue.

6. A blade attachment assembly as in claim 5:

said platform angle being greater than 30 degrees.

7. A blade attachment assembly as in claim 1:

said platform angle being greater than 30 degrees.

* * * * *

UNITED STATES PATENT AND TRADEMARK OFFICE

CERTIFICATE OF CORRECTION

PATENT NO. : 5,022,822

DATED : June 11, 1991

INVENTOR(S) : Steven M. Sincere

It is certified that error appears in the above-identified patent and that said Letters Patent is hereby corrected as shown below:

Column 1, after the title, insert the following paragraph:

— The Government has rights in the invention pursuant to a contract awarded by the Department of the Navy.--

Column 1, line 14, "decreasingly" should read --decreasing--

Column 3, Claim 1, line 1, after "arrangements" change ";" to --,--

Column 3, Claim 2, line 15, after "wherein" insert --each--, and

Signed and Sealed this

Twelfth Day of January, 1993

*Attest:*

DOUGLAS B. COMER

*Attesting Officer*

*Acting Commissioner of Patents and Trademarks*